US011008150B2

(12) United States Patent
Nakamichi

(10) Patent No.: US 11,008,150 B2
(45) Date of Patent: May 18, 2021

(54) STORAGE CONTAINER

(71) Applicant: SAKAI DISPLAY PRODUCTS CORPORATION, Sakai (JP)

(72) Inventor: Kazuki Nakamichi, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 260 days.

(21) Appl. No.: 16/302,554

(22) PCT Filed: May 18, 2016

(86) PCT No.: PCT/JP2016/064743
§ 371 (c)(1),
(2) Date: Mar. 15, 2019

(87) PCT Pub. No.: WO2017/199372
PCT Pub. Date: Nov. 23, 2017

(65) Prior Publication Data
US 2019/0300261 A1 Oct. 3, 2019

(51) Int. Cl.
*B65D 81/113* (2006.01)
*B65D 81/05* (2006.01)
*B65D 59/00* (2006.01)
*B65D 85/00* (2006.01)

(52) U.S. Cl.
CPC ..... *B65D 81/113* (2013.01); *B65D 59/00* (2013.01); *B65D 81/053* (2013.01); *B65D 85/00* (2013.01); *B65D 2581/055* (2013.01)

(58) Field of Classification Search
CPC ..... B65D 81/113; B65D 81/053; B65D 2581/055; B65D 85/30; B65D 81/054; B65D 25/10; B65D 81/107; B65D 85/48
USPC ..... 206/586, 453, 722, 701
See application file for complete search history.

(56) References Cited

U.S. PATENT DOCUMENTS 9,010,534 B2 * 4/2015 Kuo ..... B65D 81/052 206/454
10,457,464 B2 * 10/2019 Lv ..... B65D 81/107
2008/0128310 A1 * 6/2008 Kao ..... B65D 81/107 206/521

(Continued)

FOREIGN PATENT DOCUMENTS

JP 2004-010131 A 1/2004
JP 2014-009020 A 1/2014

*Primary Examiner* — Steven A. Reynolds
(74) *Attorney, Agent, or Firm* — ScienBiziP, P.C.

(57) ABSTRACT

A storage container includes: a storage portion having a rectangular bottom portion, a side wall, and a hollow region; positioning members positioning a rectangular plate-like structural body inside the hollow region; positioning members positioning a rectangular plate-like structural body inside the hollow region; and grooves formed in the storage portion, each of the grooves being formed in the inner side surface at an inner corner of the bottom surface, and two of the grooves being formed at two inner corners adjacent to each other. Each of the positioning members is detachably fitted into the storage portion into corresponding one of grooves. Each of the positioning members includes a joint member in contact with one of the grooves and a contact member detachably fitted into each other. The contact member includes an engaged portion, a contact portion, and an intervening portion integrally formed with the contact portion.

6 Claims, 8 Drawing Sheets

(56) References Cited

U.S. PATENT DOCUMENTS

| | | | | |
|---|---|---|---|---|
| 2013/0306514 | A1* | 11/2013 | Hu | B65D 81/053<br>206/586 |
| 2014/0262927 | A1* | 9/2014 | Guo | B65D 81/056<br>206/706 |
| 2020/0071052 | A1* | 3/2020 | Cheng | B65D 81/054 |

* cited by examiner

STORAGE CONTAINER

TECHNICAL FIELD

The present invention relates to a storage container having a hollow region, defined by an inner side surface and a bottom surface, to store a storage target.

BACKGROUND ART

Conventionally, a storage container storing and transporting a plate-like structural body like a panel is in wide use.

Patent Document No. 1, for example, discloses a packing container including a container main body storing a panel, which is a packing target, and a lid. At a inner corner of a bottom surface of the container main body, a corner protection member detachably fitted to the container main body and protecting a corner of the panel is provided.

CITATION LIST

Patent Literature

Patent Document No. 1: Japanese Laid-Open Patent Publication No. 2014-009020

SUMMARY OF INVENTION

Technical Problem

In a state where a structural body such a panel or the like is stored in a storage container, a corner of the panel is in contact with an inner wall surface of the storage container. Therefore, while the panel is being removed from the storage container, the corner of the panel is stuck with the inner wall surface of the storage container to make the work of removal difficult. In addition, there is an undesirable possibility that the corner of the panel is cut off as a result of being stuck with the inner wall surface.

In such a situation, the packing container described in Patent Document No. 1 includes the corner protection member detachably fitted to the container main body. Therefore, the corner protection member may be first detached, so that the panel is then removed. However, since the corner protection member is in contact with the corner of the panel, the above-described problem occurs while the corner protection member is being detached. For this reason, the packing container described in Patent Document No. 1 does not solve the above-described problem.

The present invention, made in light of this situation, has an object of providing a storage container allowing a storage target stored in a hollow region thereof to be easily removed from the hollow region.

Solution to Problem

A storage container according to the present invention includes a storage portion having a hollow region defined by an inner side surface and a bottom surface; and a positioning member positioning a storage target, to be stored in the storage portion, inside the hollow region. In the storage portion, a groove is formed in the inner side surface in a direction from an end of the inner side surface toward the bottom surface. The positioning member is detachably fitted into the storage portion as a result of sliding in the direction into the groove. The positioning member includes a joint member in contact with the groove and a contact member in contact with an end of the storage target to be stored in the storage portion, the joint member and the contact member being detachably fitted into each other as a result of sliding in the direction.

According to the present invention, the joint member and the contact member of the positioning member are detachably fitted into each other as a result of sliding in the direction. Therefore, the joint member may be pulled from the storage portion in a direction from the bottom surface toward the end of the inner side surface, and thus the positioning member and the storage portion are easily released from the fitting state.

Advantageous Effects of Invention

According to the present invention, the positioning member and the storage portion are easily released from a fitting state by a simple operation of pulling the joint member from the storage portion in the direction from the bottom surface toward the end of the inner side surface. Therefore, the storage target stored in the hollow region of the storage container is easily removed.

DESCRIPTION OF EMBODIMENTS

Hereinafter, a storage container according to an embodiment of the present invention will be described in detail with reference to the drawings.

Figure 1:
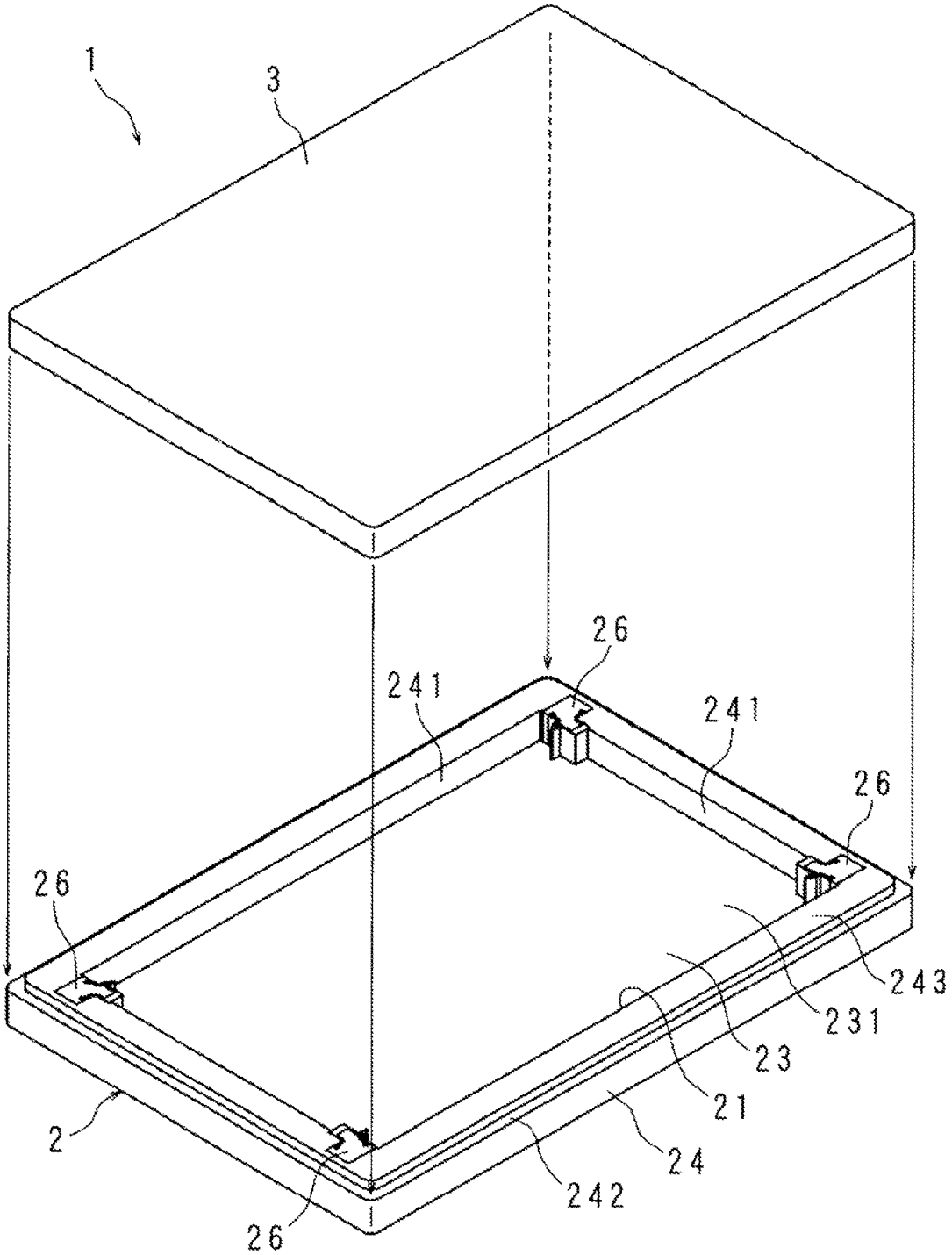
FIG. 1 is a perspective view schematically showing a storage container according to an embodiment of the present invention.

FIG. 1 is a perspective view schematically showing a storage container according to an embodiment of the present invention. In FIG. 1, reference sign 1 represents the storage container according to an embodiment of the present invention. The storage container 1 includes a storage portion 2 storing a storage target, and a lid 2. The storage container 1 having such a structure is a housing that stores one or a plurality of rectangular plate-like structural bodies.

Figure 2:
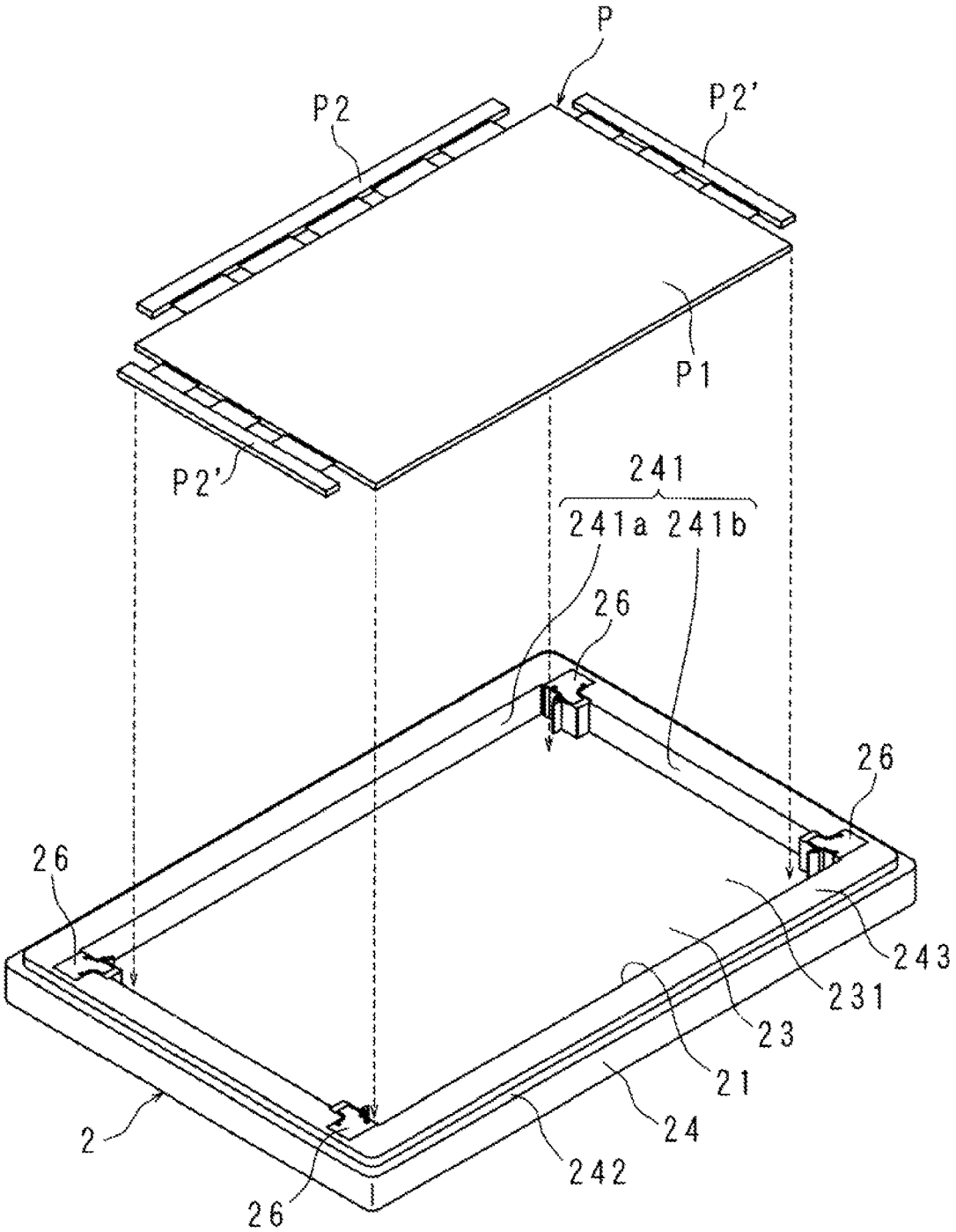
FIG. 2 shows an example of state where a rectangular plate-like structural body is put into the storage container according to an embodiment of the present invention.

FIG. 2 shows an example of state where a rectangular plate-like structural body is put into the storage container 1 according to an embodiment of the present invention. FIG. 2 shows an example of state where a display panel P is put into the storage container 1 as a storage target. For the sake of convenience, the lid 3 is not shown.

The storage portion 2 and the lid 3 are formed of a foamed resin well known in the art. Preferably usable foamed resins include a thermoplastic resin, a thermosetting resin, an engineering plastic material, and a rubber/elastomer-based resin. A thermoplastic foamed resin such as, for example, a polystyrene-based resin, a polyolefin-based resin, a polyester-based resin, a polycarbonate-based resin, a poly(vinyl chloride) resin or the like is more preferred.

The storage portion 2 includes a rectangular bottom portion 23 and a side wall 24 provided around the bottom portion 23, and has a hollow region enclosed by the bottom portion 23 and the side wall 24. In the hollow region, a storage target is to be stored. The side wall 24 extends from a perimeter of the bottom portion 23. Specifically, the bottom portion 23 has a bottom surface 231, which is a surface of the storage portion 2 directed inward. The side wall 24 has an inner side surface 241, which is a surface of the storage portion 2 directed inward. An end of the storage target stored in the hollow region faces the inner side surface 241.

As shown in the figures, the hollow region is defined by the bottom surface 231 and the inner side surface 241 vertical to the bottom surface 231. The storage target is put into the hollow region of the storage portion 2 via an opening facing the bottom portion 23. The opening is defined by an opening end 21, which is one of ends of the inner side surface 241 that is farther from the bottom portion 23. In FIG. 1 and FIG. 2, the storage portion 2 is shown as a cuboid housing having the opening facing the bottom surface 231. Hereinafter, a direction vertical to the bottom portion 23 will be referred to as a "depth direction of the hollow region" for the sake of convenience.

The storage portion 2 is provided with positioning members 26 respectively located at four inner corners thereof. The positioning members 26 position the storage target in the hollow region when the storage target is put into the storage portion 2.

Figure 3:
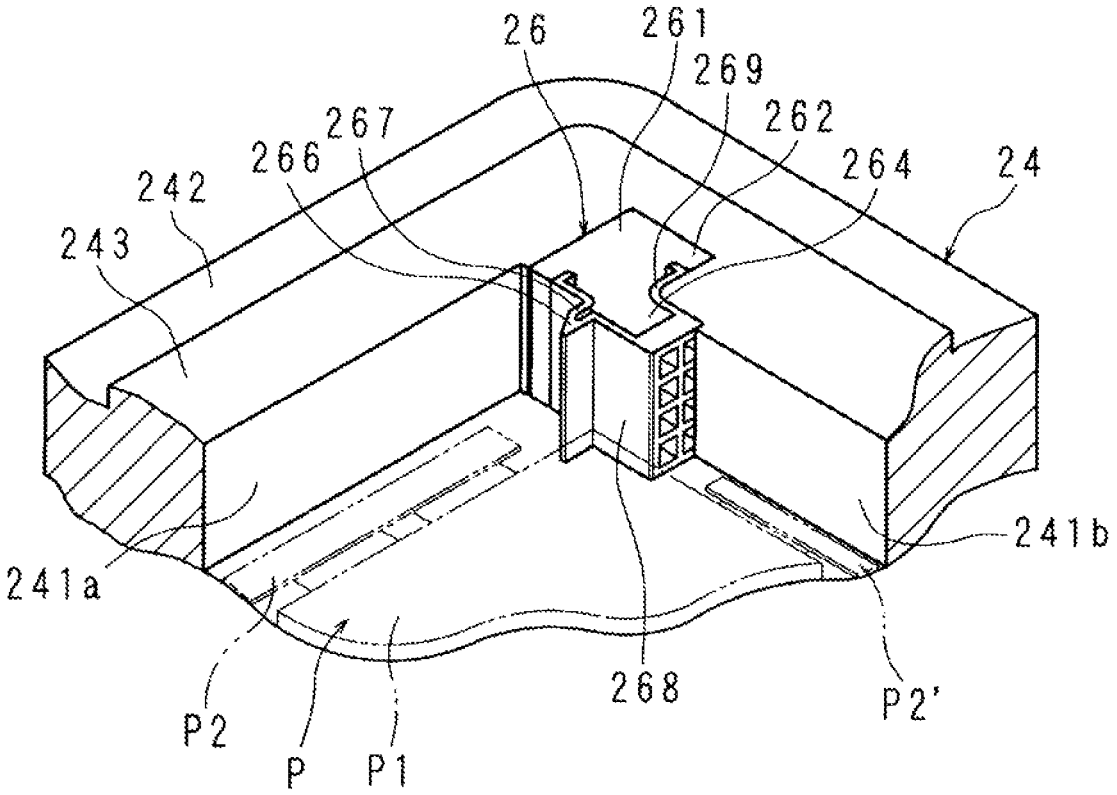
FIG. 3 is an enlarged view of a positioning member and the vicinity thereof in the storage container according to an embodiment of the present invention.
Figure 4:
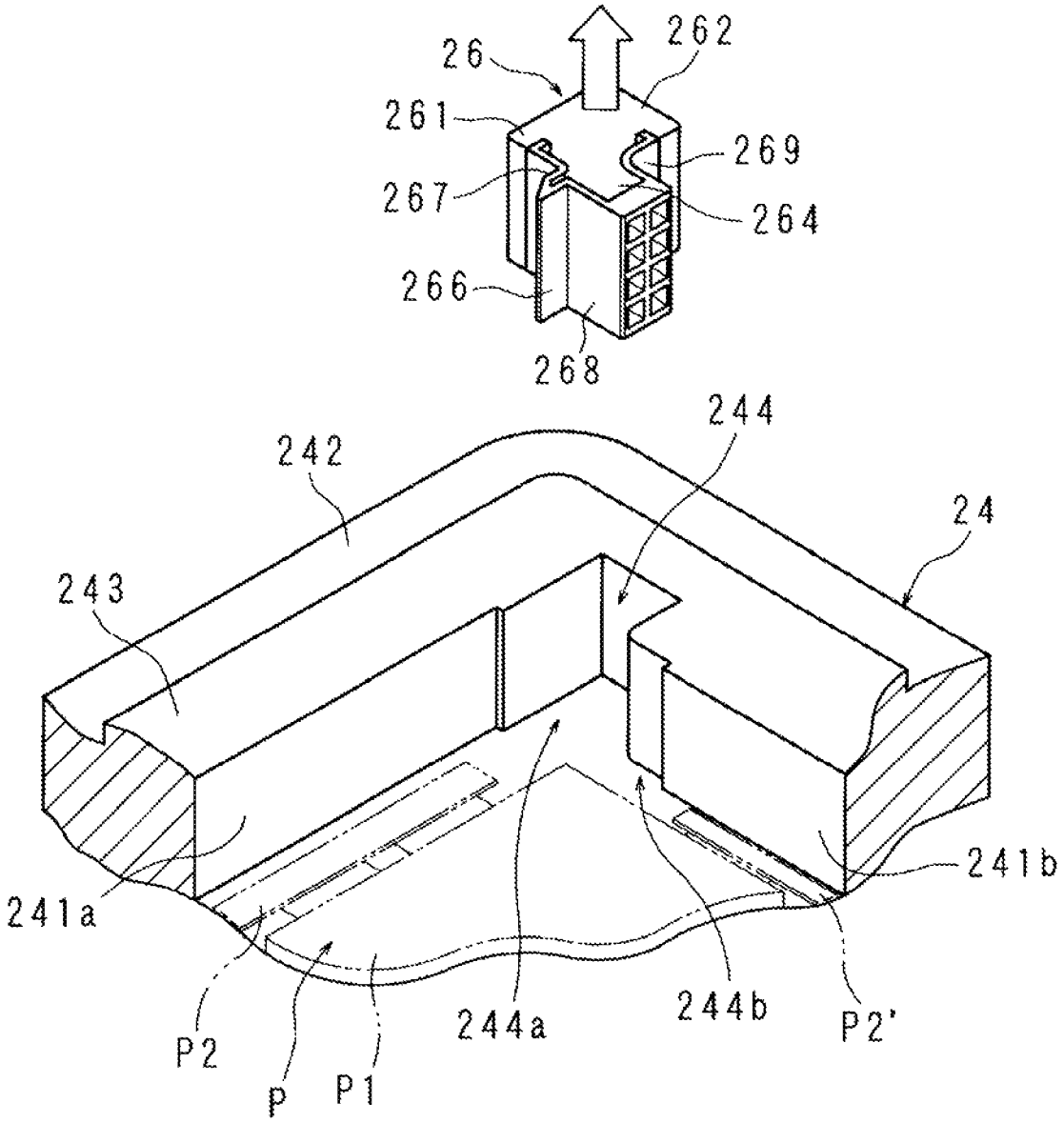
FIG. 4 shows a state where the positioning member is detached from the state shown in FIG. 3.

FIG. 3 is an enlarged view of one of the positioning members 26 and the vicinity thereof in the storage container 1 according to an embodiment of the present invention. FIG. 4 shows a state where the positioning member 26 is detached from the state shown in FIG. 3. FIG. 3 and FIG. 4 each show a state where the display panel P is stored in the hollow region.

In the inner side surface 241 of the storage portion 2, grooves 244 are respectively formed at the four inner corners thereof. In more detail, the grooves 244 are respectively formed at intersections of inner side surfaces 241*a* extending in a longer direction of the side wall 24 of the storage portion 2 and inner side surfaces 241*b* extending in a shorter direction of the side wall 24. Hereinafter, the inner side surfaces 241*a* and the inner side surfaces 241*b* may also be collectively referred to the "inner side surface 241".

Each of the grooves 244 is formed in a direction from an end of the inner side surface 241 defining the opening end 21, namely, from an edge of an end surface 243 of the side wall 24, toward the bottom surface 231. Each of the positioning members 26 slides into the corresponding groove 244 from the edge of the end surface 243 toward the bottom surface 231, and thus is fitted into the storing portion 2 (groove 244). The positioning member 26 and the storage portion 2 (groove 244) are detachable from each other.

Each positioning member 26 includes a joint member 261 to be in contact with the groove 244 and a contact member 266 to be in contact with a corner of the display panel P, which is an end of the storage target. The joint member 261 and the contact member 266 are input into engagement with each other as a result of sliding in the depth direction of the hollow region, more specifically, toward the bottom surface 231. The joint member 261 and the contact member 266 are disengageable from each other.

Figure 5:
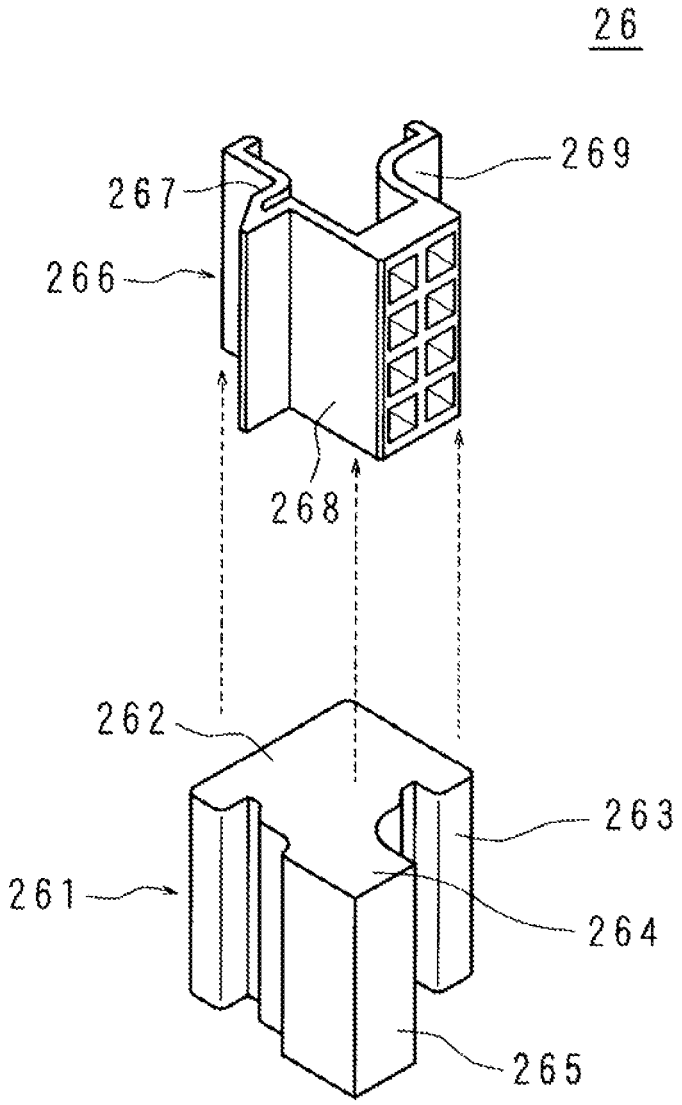
FIG. 5 is a perspective view showing a specific structure of the positioning member according to an embodiment of the present invention.

FIG. 5 is a perspective view showing a specific structure of the positioning member 26 according to an embodiment of the present invention, and shows the positioning member 26 in a state where the joint member 261 and the contact member 266 are disengaged from each other.

The joint member 261 includes a fitting portion 262 to be fitted into the groove 244 and an engaging portion 264 to be engaged with the contact member 266. The joint member 261 may be provided as being divided into a portion to be fitted into the groove 244 and a portion to be engaged with the contact member 266. FIG. 5 shows the joint member 261 including the fitting portion 262 and the engaging portion 264 formed integrally. The fitting portion 262 contacts the groove 244 along a side surface 263, and the engaging portion 264 contacts the contact member 266 along a side surface 265.

The contact member 266 includes an engaged portion 267 to be engaged with the engaging portion 264, a contact portion 268 to be put into contact with the corner of the storage target, and an intervening portion 269. The contact member 266 may be provided as being divided into a portion to be engaged with the joint member 261, a portion to be put into contact with the corner of the storage target, and a portion to be provided between the engaging portion 264 and the side wall 24. FIG. 5 shows the contact member 266 including the engaged portion 267, the contact portion 268 and the intervening portion 269 formed integrally. The engaged portion 267 is shaped in correspondence with the side surface 265 of the engaging portion 264. In a state where the positioning member 26 is fitted into the groove 244, the intervening portion 269 is located between the side wall 24 and the engaging portion 264. The contact portion 268 includes two contact surfaces receiving the corner of the storage target. The two contact surfaces form a generally right angle. The contact surfaces of the contact portion 268 may be a part of an outer surface of the contact member 266 formed integrally.

The groove 244 includes a fitting recess 244*a* into which the fitting portion 262 of the joint member 261 is to be fitted, and a step 244*b* provided at one of ends of the inner side surface 241*b* that is closer to the fitting recess 244*a*. The fitting recess 244*a* and the step 244*b* are formed in the depth direction of the hollow region, more specifically, from the opening end 21 toward the bottom surface 231.

As shown in FIG. 3, each positioning member 26 slides into the groove 244 in the depth direction of the hollow region, more specifically, toward the bottom surface 231, and thus is fitted into the groove 244. In this state, the joint member 261 is fitted into the fitting recess 244*a*, and the engaging portion 264 of the joint member 261 is engaged with the engaged portion 267 of the contact member 266. Also in this state, the intervening portion 269 is located between the joint member 261 and the side wall 24 at the step 244*b*, and is held between the joint member 261 and the side wall 24.

As described above, the positioning members 26 are fitted into the grooves 244 respectively formed at the four inner corners of the storage portion 2, and thus are attached to the storage portion 2. In this state, the contact member 266 is restricted from moving in a direction along the bottom surface 231. Therefore, the above-described two contact surfaces of the contact portion 268 of the contact member 266 of each of the positioning members 26 receives the corresponding corner of the display panel P, and thus the display panel P is positioned in the hollow region.

With such an arrangement, even if, for example, an external impact, vibration or the like is applied to the storage container 1 (especially, the storage portion 2), the display panel P avoids being positionally shifted. Therefore, the display panel P is prevented from being damaged due to collision of the display panel P and the inner side surface 241.

In the positioning member 26, the joint member 261 and the contact member 266 are engaged with each other, and are in contact with each other along a plane. Therefore, even if an impact or the like is applied from outside the storage container 1 to the display panel P to vibrate the display panel P, an impact to the storage container 1 due to such a vibration is transmitted to the positioning member 26 via the corner of the display panel P and thus is alleviated by the contact surfaces along which the joint member 261 and the contact member 266 are in contact with each other.

In addition, the joint member 261 and the contact member 266 are engaged with each other in the positioning member 26. Therefore, when the positioning member 26 is to be removed from the storage portion 2, the joint member 261 and the contact member 266 may be disengaged from each other so as to be removed separately.

In the meantime, in the case where the display panel P stored in the hollow region is a member to be used for a display apparatus, the display panel P includes a rectangular panel P1 and at least one of circuit boards P2 and P2' (components) provided via a PWB (Printed Wiring Board) or an SOF (System on Film) along at least one of end surfaces of the panel P1, namely, along at least one of ends of the storage target. The at least one of the circuit boards P2 and P2' protrudes toward the inner side surface 241 of the storage portion 2. The circuit board P2 extends in a longer direction of the panel P1, and the circuit boards P2' extend in a shorter direction of the panel P1. In this specification, an end surface of the panel P1 is one of four side surfaces enclosing two main surfaces of the rectangular panel, and is a region between two adjacent corners of the panel P1.

If, while the display panel P is put into the storage container 1, the circuit board P2 collides against the storage portion 2, the circuit board P2 may possibly be damaged. In the storage portion 2, the positioning members 26 are provided to separate the circuit board P2 and the side wall 24 (inner side surface 241) from each other such that the circuit board P2 stored in the storage portion 2 does not collide against the side wall 24 (inner side surface 241). It is preferred that the positioning members 26 are provided at two positions sandwiching a region of the inner side surface 241 that faces the circuit board P2.

FIG. 2 shows a structure in which the rectangular panel P1 is provided with circuit boards P2 and P2' along three of the end surfaces thereof. In order to prevent the circuit boards P2 and P2' from colliding against the side wall 24 while the panel P1 having such a structure is put into the storage portion 2, the positioning members 26 are formed at positions not facing the circuit boards P2 and P2' of the display panel P. Namely, in FIG. 2, the positioning members 26 are provided at two positions sandwiching the region of the inner side surface 241 that faces each of the circuit boards P2 and P2'. More specifically, the positioning members 26 (grooves 244) are provided at the four inner corners of the storage portion 2.

With such a structure, as shown in FIG. 3 and FIG. 4, the display panel P is positioned in the hollow region such that the circuit board P2 of the display panel P does not collide against the region between the two positioning members 26 adjacent to each other in the longer direction of the storage portion 2 (against the inner side surface 241*a*) and such that each of the circuit boards P2' of the display panel P does not collide against the region between the two positioning members 26 adjacent to each other in the shorter direction of the storage portion 2 (such that the circuit boards P2' do not collide against the inner side surfaces 241*b*).

Therefore, even if the display panel P is vibrated by an impact, vibration or the like applied from outside the storage container 1, none of the circuit boards P2 and P2' collides against the positioning members 26, or none of the circuit boards P2 and P2' collides against the inner side surface 241 of the side wall 24. Therefore, none of the circuit boards P2 and P2' is damaged.

In the above, with reference to FIG. 2, the present embodiment is described by way of an example in which the positioning members 26 (grooves 244) are provided at the four inner corners of the storage portion 2. An embodiment of the present invention is not limited to this. The positioning members 26 (grooves 244) may be provided at positions other than the four inner corners of the storage portion 2, as long as not facing any of the circuit boards P2 and P2' of the display panel P. In the case where, for example, a display panel P including either one of the circuit boards P2 and P2' is to be stored, it is sufficient that the positioning members 26 (groove 244) are provided at two positions sandwiching a region, of the inner side surface 241 of the side wall 24, that faces such a circuit board. Preferably, the two positioning members 26 (grooves 244) are provided at two inner corners of the storage portion 2 adjacent to each other such that the circuit board is located between the two positioning members 26.

In order to position the display panel P in the hollow region more reliably, it is preferred that a region of an end surface of the panel P1 along which none of the circuit boards P2 and P2' is provided (hereinafter, such a region will be referred to as a "non-mounting region") is in contact with a part of the side wall 24 that faces the region, as long as the region does not interfere with any positioning member 26. Therefore, the side wall 24 may have a shape required to directly contact the non-mounting region. Alternatively, a connection tool may be located between the panel P1 and the inner side surface 241, so that the inner side surface 241 is in indirect contact with the non-mounting region.

Figure 6:
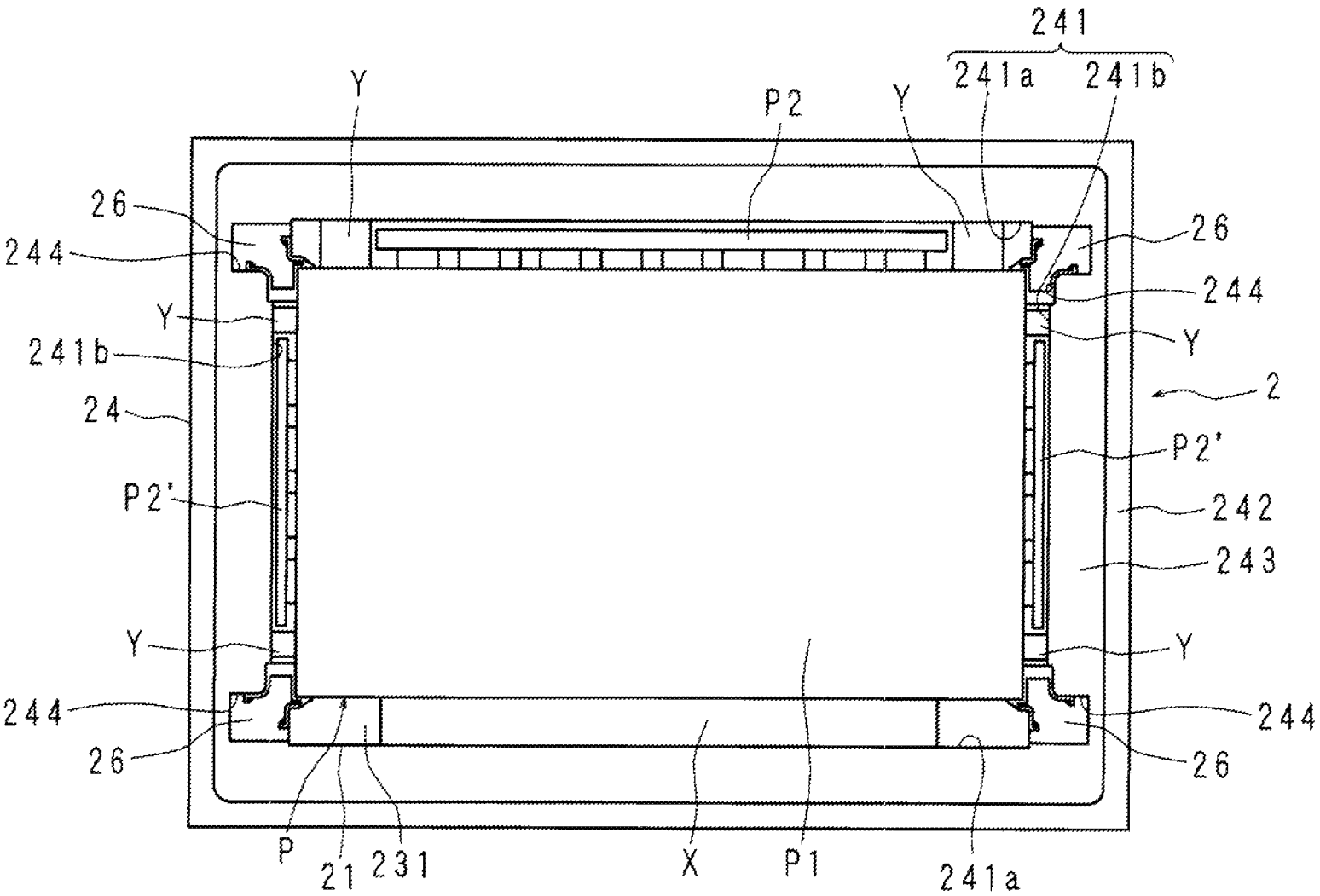
FIG. 6 shows an example of state where connection tools are located between a panel and an inner side surface in the storage container according to an embodiment of the present invention.

FIG. 6 shows an example of state where connection tools are located between the panel P1 and the inner side surface 241 in the storage container 1 according to an embodiment of the present invention.

As shown in FIG. 6, connection tools Y are respectively provided on both sides of the circuit board P2 extending in the longer direction of the panel P1. Namely, on both sides of the circuit board P2, the connection tools Y are located between the circuit board P2 and the positioning members 26, and the end surface of the panel P1 extending in the longer direction is in contact with the inner side surface 241*a* via the connection tools Y. Therefore, the side wall 24 supports the panel P1 via the connection tools Y.

A connection tool X is located between the inner side surface 241*a* and the end surface of the panel 1 which extends in the longer direction and along which the circuit board P2 is not provided. The connection tool X is located as extending in the longer direction of the panel P1, between two of the positioning members 26 adjacent to each other. The end surface of the panel P1 extending in the longer direction is in contact with the inner side surface 241*a* via the connection tool X. Therefore, the side wall 24 supports the panel P1 via the connection tool X.

Connection tools Y are respectively provided on both sides of each of the circuit boards P2' extending in the shorter direction of the panel P1. Namely, on both sides of each of the circuit boards P2', the connection tools Y are located between the circuit board P2' and the positioning members 26. Each of the end surfaces of the panel P1 extending in the shorter direction is in contact with the inner side surface 241*b* via the connection tools Y. Therefore, the side wall 24 supports the panel P1 via the connection tools Y.

The connection tools X and Y may be independent from, or integral with, the side wall 24. The connection tools X and Y are formed of, for example, a material same as that of the storage portion 2.

In the case where two positioning members 26 are respectively provided at two adjacent inner corners among the inner corners of the storage portion 2, the grooves 244 into which the positioning members 26 are to be fitted do not need to be formed at the two inner corners where the positioning members 26 are not provided. It is preferred that the two end surfaces of the panel P1 sandwiching each of such corners are in contact with parts of the side wall 24 that face such end surfaces.

Figure 7:
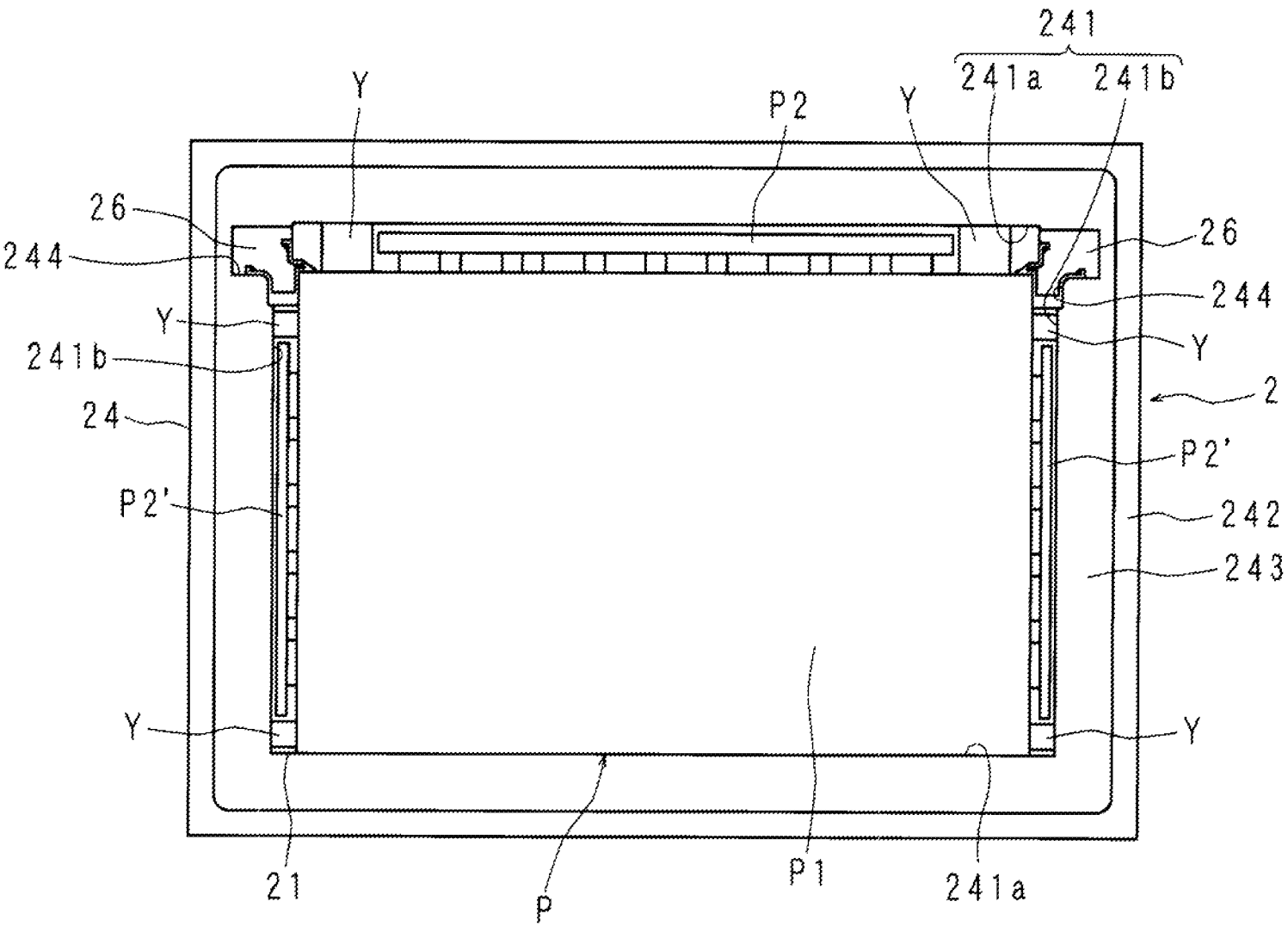
FIG. 7 shows an example of state where two positioning members are provided at only two inner corners adjacent to each other among four inner corners in a storage portion of the storage container according to an embodiment of the present invention.

FIG. 7 shows an example of state where two positioning members 26 are provided at only two inner corners adjacent to each other among the four inner corners in the storage portion 2 of the storage container 1 according to an embodiment of the present invention. In FIG. 7, the grooves 244 are not formed at the two inner corners where the positioning members 26 are not provided.

On both sides of the circuit board P2 extending in the longer direction of the panel P1, the connection tools Y are located between the panel P1 and the positioning members 26. Namely, the end surface of the panel P1 extending in the longer direction is in contact with the inner side surface 241*a* via the connection tools Y. Therefore, the side wall 24 supports the panel P1 via the connection tools Y.

On both sides of each of the circuit boards P2' extending in the shorter direction of the panel P1, the connection tools Y are located between the circuit board P2' and the positioning member 26 or the inner side surface 241*a*. Namely, the end surface of the panel P1 extending in the shorter direction thereof is in contact with the inner side surface 241*b* via the connection tools Y. Therefore, the side wall 24 supports the panel P1 via the connection tools Y.

The end surface of the panel P1 which extends in the longer direction and along which the circuit board P2 is not provided is in direct contact with the inner side surface 241*a*. Therefore, the side wall 24 directly supports the panel P1.

As described above, at the two corners of the panel P1 that are not in contact with the positioning members 26, the end surfaces of the panel P1 extending in the shorter direction are in indirect contact with parts of the side wall 24 that face such end surfaces via the connection tools Y, whereas the end surface of the panel P1 extending in the longer direction is in direct contact with a part of the side wall 24 that faces such an end surface.

The joint member 261 is formed of, for example, a material same as that of the storage portion 2 and the lid 3. The material of the joint member 261 is not limited to this, and may be any material that absorbs an impact transmitted from the corresponding corner of the display panel P.

The contact member 266 is formed of a material harder than that of the storage portion 2 and the lid 3. The material preferably usable for the contact member 266 is, for example, a polystyrene-based resin, a polyolefin-based resin, an acrylic resin, a polycarbonate-based resin or the like, but is not limited to any of these materials.

As described above, the contact member 266 is harder than the storage portion 2 and the lid 3, and thus is not easily deformed. Therefore, even in a state where an impact, vibration or the like is applied to the storage container 1 and the load is concentrated to a corner of the display panel P, the contact member 266 receives the corner of the display panel P without being deformed or broken.

The lid 3 has a flat cuboid shape. The sizes of the lid 3 in the shorter direction and the longer direction match the sizes of the storage portion 2. The lid 3 includes a protruding portion (not shown), facing the storage portion 2, along a perimeter thereof, and the protruding portion is fitted into an end surface groove 242 formed around, and outer to, the end surface 243 of the storage portion 2. With such a structure, the lid 3 covers the storage portion 2 and seals the opening of the storage portion 2. Alternatively, the lid 3 may have a recess (not shown) along, and inner to, the protrusion, and the end surface 243 of the storage portion 2 may be fitted into such a recess.

The present embodiment is described above by way of the storage container 1 including the storage portion 2 and the lid 3. The present invention is not limited to the form in which one lid 3 is used for one storage portion 2. A form in which a plurality of the storage portions 2 are stacked, and a form in which one lid 3 is located on the uppermost storage portion 2 among the plurality of stacked storage portions 2, are encompassed in the scope of the present invention. In this case, it is preferred that the same element as the protrusion and/or the recess of the lid 3 is formed on a rear surface of the bottom portion 23 (surface opposite to the bottom surface 231) such that the stacked storage portions 2 are fitted into each other in substantially the same manner as the manner in which the storage portion 2 and the lid 3 are fitted into each other.

In a state where the display panel P is stored in the hollow region, each of the corners of the display panel P is in contact with the contact surfaces, of the contact portion 268 of the positioning member 26, that receive the corner. Therefore, while the display panel P is being removed from the storage portion 2 (the hollow region), a corner of the display panel P is stuck with the contact surfaces of the contact portion 268. This may undesirably prevent the work of removal from being done easily, and may further cut off the corner of the display panel P.

However, in the storage container 1 according to an embodiment of the present invention, the above-described problem does not occur while the stored display panel P is being removed from the hollow region.

Figure 8:
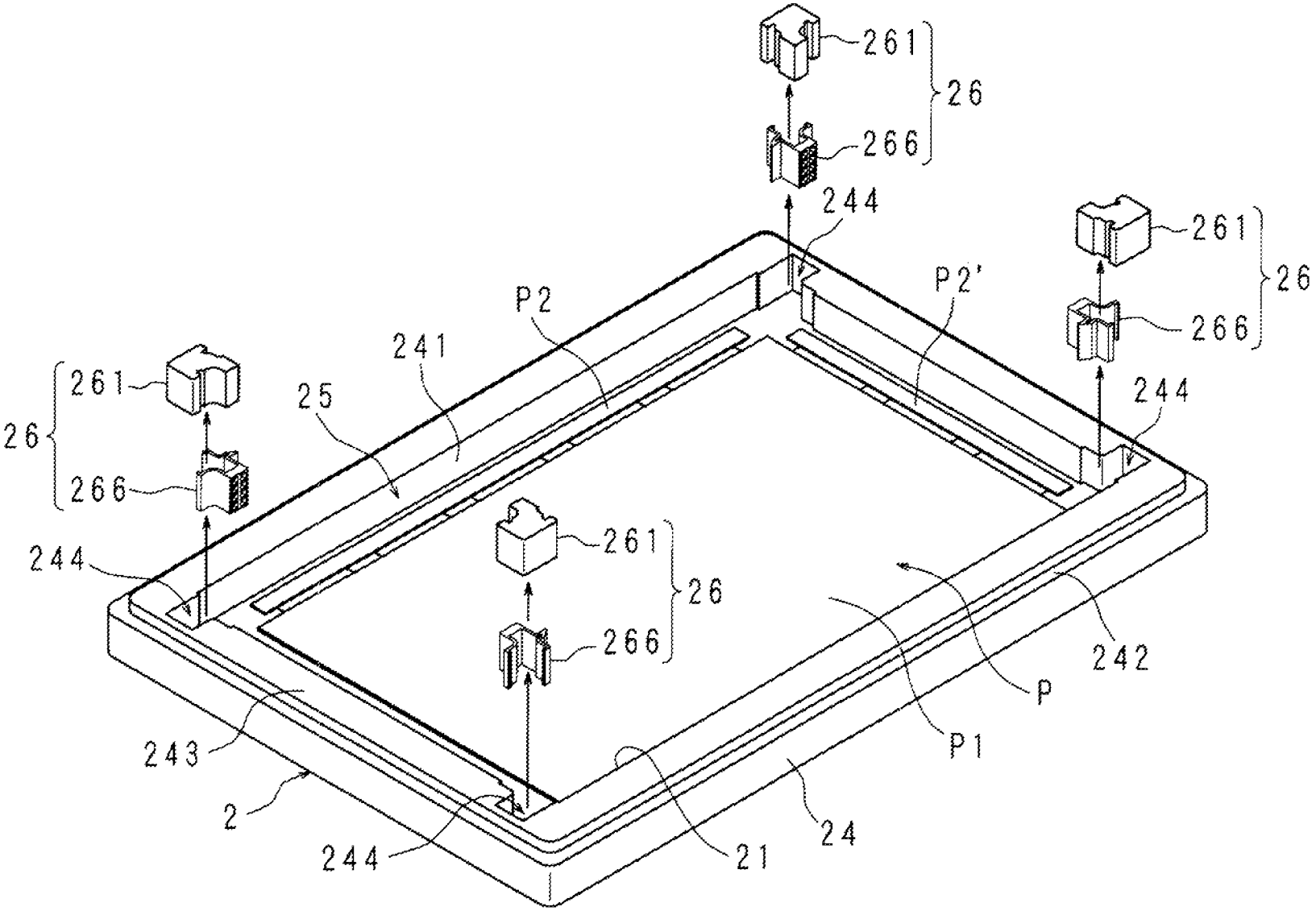
FIG. 8 shows a method for removing the panel stored in a hollow region of the storage container according to an embodiment of the present invention.

Hereinafter, a method for removing the display panel P stored in the hollow region of the storage container 1 according to an embodiment of the present invention will be described with reference to FIG. 8.

In the storage container 1 according to an embodiment of the present invention, the joint member 261 is fitted into the groove 244 as a result of sliding in the depth direction of the hollow region, and is in engagement with the contact member 266 as a result of sliding in the depth direction of the hollow region. Therefore, a user may first pull the joint member 261 in the depth direction of the storage portion 2

(see the solid-line arrow in FIG. 8), so that the joint member 261 and the contact member 266 are disengaged from each other and the joint portion 261 and the fitting recess 244*a* are released from the fitting state. In this manner, the fitting recess 244*a* occupied by the joint member 261 is emptied.

Next, the user pulls the contact member 266 in the depth direction of the storage portion 2 (see the solid-line arrow in FIG. 8) while moving the contact member 266 into the open space of the fitting recess 244*a*, so as to release the contact surfaces of the contact portion 268 from the contact state with the corner of the display panel P.

With such a procedure, the joint member 261 and the contact member 266 of the positioning member 26 are easily removed from the storage portion 2.

After this, the user removes the display panel P from the hollow region of the storage portion 2. At this point, the positioning members 26 are already removed. Therefore, the corner of the display panel P is not stuck with the contact surfaces of the contact portion 268, or the corner of the display panel P is not cut off.

In the above, an example of form in which the positioning members 26 (grooves 244) are respectively provided at the four inner corners of the storage portion 2 is described. An embodiment of the present invention is not limited to this. For example, in the case where the display panel P having either one of the circuit boards P2 and P2' is to be stored, the positioning members 26 may be provided at two inner corners adjacent to each other among the four inner corners of the storage portion 2 so as to sandwich a region facing the circuit board. In more detail, the positioning members 26 may be provided at only the two ends of the inner side surface 241*a* or at only the two ends of the inner side surface 241*b*.

REFERENCE SIGNS LIST

1 storage container
2 storage portion
25 hollow region
26 positioning member
231 bottom surface
241 inner side surface
244 groove
261 joint member
266 contact member
P2 circuit board

The invention claimed is:

1. A storage container, comprising:

a storage portion having a rectangular bottom portion and a side wall provided around the bottom portion, and a hollow region defined by an inner side surface of the side wall and a bottom surface of the bottom portion and having a generally cuboid shape;

a plurality of positioning members positioning a rectangular plate-like structural body inside the hollow region; and a plurality of grooves formed in the storage portion, each of the plurality of grooves being formed in the inner side surface at an inner corner of the bottom surface in a direction from an end of the inner side surface toward the bottom surface, and two of the plurality of grooves being formed at two inner corners adjacent to each other among four conners of the bottom surface, wherein each of the plurality of positioning members is detachably fitted into the storage portion as a result of sliding in the direction into corresponding one of the plurality of grooves, wherein each of the plurality of positioning members includes a joint member in contact with the corresponding one of the plurality of grooves and a contact member detachably fitted into each other as a result of sliding in the direction, wherein the contact member includes:

an engaged portion to be engaged with the joint member, a contact portion having two contact surfaces receiving a corner of the rectangular plate-like structural body and forming a generally right angle, and an intervening portion to be provided between the side wall and the joint member, and wherein the contact portion and the intervening portion are formed integrally.

2. The storage container of claim 1, wherein the rectangular plate-like structure body includes one or a plurality of components provided along an end thereof so as to protrude toward the inner side surface, the plurality of positioning members are provided so as not to face the one or the plurality of components.

3. The storage container of claim 2, wherein a region between the two of the plurality of grooves faces one or each of the plurality of components.

4. The storage container of claim 3, wherein the plurality of grooves are formed at four inner corners of the bottom surface.

5. The storage container of claim 1, wherein the storage portion and the joint member are formed of a foamed resin.

6. The storage container of claim 5, wherein the contact member is formed of a material harder than a material of the storage portion.

* * * * *